US006913513B2

(12) United States Patent
Kimura et al.

(10) Patent No.: US 6,913,513 B2
(45) Date of Patent: Jul. 5, 2005

(54) POLISHING APPARATUS

(75) Inventors: Norio Kimura, Fujisawa (JP); Katsuya Okumura, Tokyo (JP); Hiroyuki Yano, Yokohama (JP)

(73) Assignees: Ebara Corporation, Tokyo (JP); Kabushiki Kaisha Toshiba, Kanagawa-ken (JP)

( * ) Notice: Subject to any disclaimer, the term of this patent is extended or adjusted under 35 U.S.C. 154(b) by 0 days.

(21) Appl. No.: 09/784,171

(22) Filed: Feb. 16, 2001

(65) Prior Publication Data

US 2001/0023167 A1 Sep. 20, 2001

(30) Foreign Application Priority Data

Feb. 16, 2000 (JP) ..... 2000-038739

(51) Int. Cl.[7] ..... B24B 49/12
(52) U.S. Cl. ..... 451/6; 451/5; 451/41
(58) Field of Search ..... 451/6, 5, 41, 288, 451/287, 526, 533

(56) References Cited

U.S. PATENT DOCUMENTS

| | | | | | |
|---|---|---|---|---|---|
| 2,231,900 | A | * | 2/1941 | Geoffrion | 451/58 |
| 2,979,867 | A | * | 4/1961 | Beaver | 451/278 |
| 5,672,091 | A | | 9/1997 | Takahashi et al. | |
| 5,674,109 | A | * | 10/1997 | Kanzawa et al. | 451/41 |
| 5,964,643 | A | | 10/1999 | Birang et al. | |
| 6,213,844 | B1 | * | 4/2001 | Lenkersdorfer | 451/6 |
| 6,217,410 | B1 | * | 4/2001 | Holzapfel et al. | 451/6 |
| 6,334,807 | B1 | * | 1/2002 | Lebel et al. | 451/6 |

FOREIGN PATENT DOCUMENTS

| | | | | |
|---|---|---|---|---|
| AU | 245213 | * | 4/1963 | 451/548 |
| GB | 2207626 | * | 2/1989 | 451/490 |
| JP | 403234467 | * | 10/1991 | 451/6 |
| JP | 06-252113 | | 9/1994 | |

* cited by examiner

*Primary Examiner*—Robert A. Rose
(74) *Attorney, Agent, or Firm*—Wenderoth, Lind & Ponack, L.L.P.

(57) ABSTRACT

A polishing apparatus comprises a polishing table having a polishing surface, a top ring for holding a substrate and pressing a surface of the substrate against the polishing surface to polish the surface of the substrate, and at least one optical measuring device disposed adjacent to the outer peripheral portion of the polishing table and below the polishing surface of the polishing table for measuring the thickness of a layer formed on the surface of the substrate. The polishing apparatus further comprises at least one notch formed in the peripheral portion of the polishing table. The notch allows light emitted from the optical measuring device to pass therethrough and be incident on the surface of the substrate and allows light reflected from the surface of the substrate to pass therethrough and be incident on the optical measuring device.

13 Claims, 5 Drawing Sheets

POLISHING APPARATUS

BACKGROUND OF THE INVENTION

1. Field of the Invention

The present invention relates to a polishing apparatus for polishing a substrate such as a semiconductor wafer, and more particularly to a polishing apparatus capable of continuously detecting, on a real-time basis, the thickness of an insulating film (layer) or a metallic film (layer) on a surface, being polished, of the substrate in such a state that the substrate is mounted on a substrate holder such as a top ring.

2. Description of the Related Art

In recent years, a higher integration of a semiconductor device requires the narrower wiring and the multilayer wiring, and hence it is necessary to make a surface of a semiconductor substrate highly planarized. This is because the narrower wiring has led to the use of light with shorter wavelengths in photolithography and a tolerable difference of elevation at the focal point on the substrate becomes smaller in the light with shorter wavelengths. Therefore, smaller difference of elevation at the focal point, i.e., higher flatness of the surface of the substrate is necessary.

One customary way of planarizing the surface of the semiconductor substrate is to remove irregularities (concaves and convexes) on the surface of the semiconductor substrate by a chemical mechanical polishing (CMP) process. In this case, after the semiconductor substrate is polished for a certain period of time, the polishing operation is required to be terminated at a desired position or timing. For example, in some cases, an insulating film (layer) of $SiO_2$ or the like is to be left on a metallic wiring of copper, aluminum or the like. Since a metallic layer or other layer is further deposited on the insulating layer in the subsequent process, this insulating layer is called an "interlayer." In this case, if the semiconductor substrate is polished excessively, the metallic underlayer is exposed on the surface, and hence the polishing is required to be terminated in such a state that a predetermined thickness of the interlayer remains unpolished.

Further, in some cases, interconnection grooves for a predetermined wiring pattern are formed in a semiconductor substrate, conductive materials such as copper (Cu) or copper alloy are filled in such grooves of the semiconductor substrate, and then unnecessary portions of the conductive materials on the surface of the semiconductor substrate are removed by a chemical mechanical polishing (CMP).

When the copper layer is polished by the CMP process, it is necessary that the copper layer on the semiconductor substrate be selectively removed therefrom, while leaving only the copper layer in the grooves for a wiring circuit, i.e. the interconnection grooves. More specifically, the copper layer on those surface areas of the semiconductor substrate other than the interconnection grooves needs to be removed until an oxide film of $SiO_2$ or the like is exposed. If the copper layer in the interconnection grooves is excessively polished away together with the oxide film such as $SiO_2$, then the resistance of the circuits on the semiconductor substrate would be so increased that the semiconductor substrate might possibly need to be discarded, resulting in a large loss. Conversely, if the semiconductor substrate is insufficiently polished to leave the copper layer on the oxide film, then the circuits on the semiconductor substrate would not be separated from each other, but short-circuited. As a consequence, the semiconductor substrate would be required to be polished again, and hence its manufacturing cost would be increased. This holds true for semiconductor substrates which have an electrically conductive layer of aluminum or the like that needs to be selectively be polished away by the CMP process.

Therefore, it has been proposed to detect an end point of the CMP process using an optical sensor. In such end point detecting process in the CMP process, an optical sensor comprising a light-emitting element and a light-detecting element is provided adjacent to the turntable. A top ring for holding a semiconductor substrate is moved laterally to protrude the semiconductor substrate from the outer circumferential edge of the turntable, thereby exposing the surface, being polished, of the semiconductor substrate. In this state, the light-emitting element applies light to the surface, being polished, of the semiconductor substrate, and the light-detecting element detects reflected light from the surface of the semiconductor substrate to thus measure the thickness of the insulating layer or the metallic layer on the surface of the semiconductor substrate and detect the end point of the CMP process.

However, this method is problematic in that during polishing of the semiconductor substrate, the thickness of the insulating layer or the metallic layer on the surface, being polished, of the semiconductor substrate cannot be measured at all times.

Further, in the case where the thickness of the layer is measured over a position ranging from the outermost periphery to the center of the semiconductor substrate according to the above detecting process, the protrusion of not less than 50% of the surface of the semiconductor substrate from the turntable is necessary. In this case, since the top ring has a universal joint such as a gimbal mechanism so as to follow the inclination of the polishing surface on the turntable, the top ring is inclined and the semiconductor substrate is hit against the outer peripheral edge of the turntable to cause breaking or damaging of the semiconductor substrate.

SUMMARY OF THE INVENTION

It is therefore an object of the present invention to provide a polishing apparatus which can produce a real-time continuous measured value that represents the thickness of an insulating layer or a metallic layer on a semiconductor substrate and eliminate the need to excessively protrude the surface of the semiconductor substrate from a polishing table during polishing.

According to a first aspect of the present invention, there is provided a polishing apparatus comprising: a polishing table having a polishing surface; a top ring for holding a substrate and pressing a surface of the substrate against the polishing surface to polish the surface of the substrate; at least one optical measuring device disposed adjacent to the outer peripheral portion of the polishing table and below the polishing surface of the polishing table for measuring the thickness of a layer formed on the surface of the substrate; and at least one notch formed in the peripheral portion of the polishing table, the notch allowing light emitted from the optical measuring device to pass therethrough and be incident on the surface of the substrate and allowing light reflected from the surface of the substrate to pass therethrough and be incident on the optical measuring device. The substrate has a semiconductor device threron.

According to the present invention, while the polishing table such as a turntable is rotated during polishing, the surface, being polished, of the substrate, the measuring device, and the notch are aligned vertically with each other, and light emitted from the measuring device passes through the notch and is then incident on the surface of the substrate, and then light reflected from the surface of the substrate passes through the notch and is then incident on the measuring device. Thus, the thickness of the insulating layer or the metallic layer formed on the surface of the substrate can be detected, and hence the end point of the CMP process can be accurately detected.

In a preferred aspect of the present invention, the top ring is swingable between an inner area and an outer area on the polishing table so that the light emitted from the optical measuring device is incident on a position ranging from the outer circumferential edge to the central portion of the substrate.

In a preferred aspect of the present invention, when the top ring is swung to a maximum, the area of the substrate which projects outwards beyond the outer circumferential edge of the polishing table is not more than 40% of the entire area of the surface, being polished, of the substrate.

In a preferred aspect of the present invention, a nozzle is provided for supplying a cleaning liquid to the optical measuring device.

According to a second aspect of the present invention, there is provided a polishing apparatus comprising: a polishing table having a polishing surface; a top ring for holding a substrate to polish the substrate by a relative motion between the substrate and the polishing surface; at least one optical measuring device for measuring the thickness of a layer formed on the surface of the substrate by applying light to the surface of the substrate; and a moving mechanism for moving at least one of the top ring and the polishing table during polishing operation; wherein the moving mechanism moves the top ring or the polishing table to the position where the central portion of the substrate is exposed toward the optical measuring device, for allowing the optical measuring device to measure the central portion of the substrate.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

A polishing apparatus according to embodiments of the present invention will be described below with reference to FIGS. 1 through 4.

Figure 1:
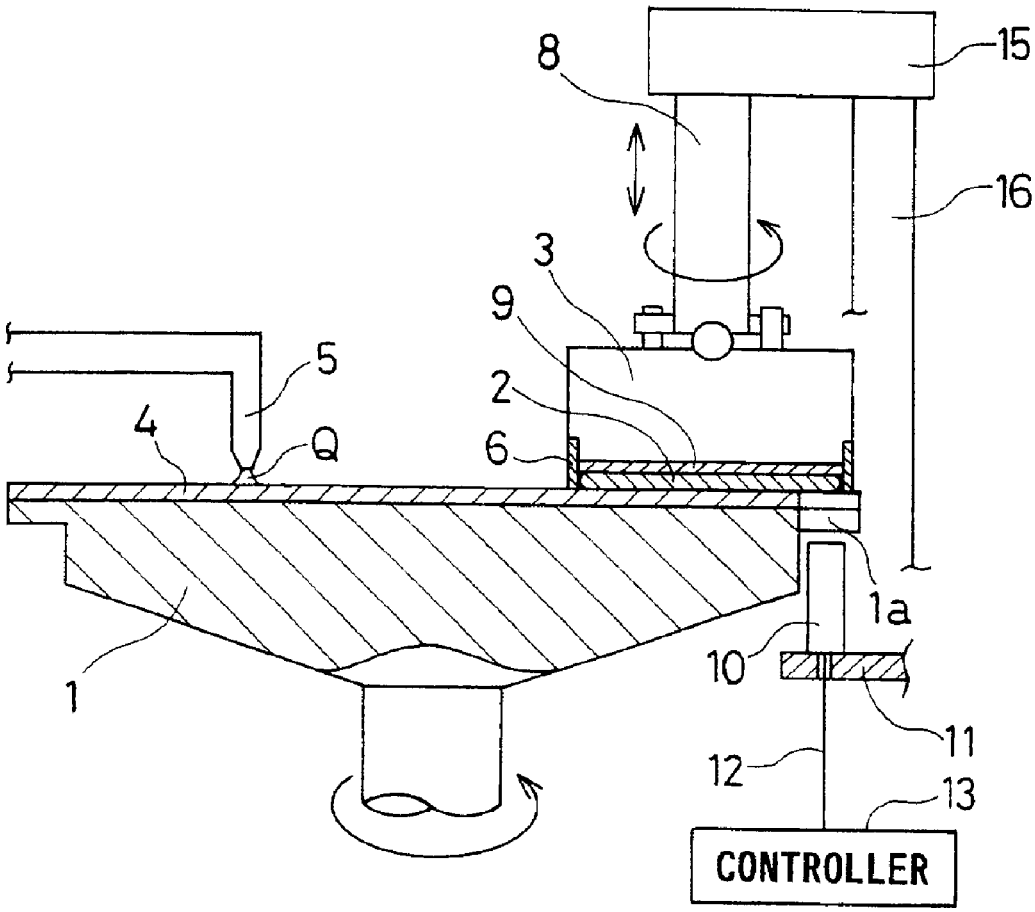
FIG. 1 is a vertical cross-sectional view of the whole structure of a polishing apparatus according to a first embodiment of the present invention.

FIG. 1 is a vertical cross-sectional view of the whole structure of a polishing apparatus according to a first embodiment of the present invention. As shown in FIG. 1, a polishing apparatus has a turntable 1 constituting a polishing table, and a top ring 3 for holding a semiconductor wafer 2 and pressing the semiconductor wafer 2 against the turntable 1. The turntable 1 is coupled to a motor (not shown), and is rotatable about its own axis, as indicated by the arrow. A polishing cloth 4 is mounted on an upper surface of the turntable 1. The upper surface of the polishing cloth 4 constitutes a polishing surface. This polishing surface may be an upper surface of a fixed abrasive plate comprising a disk of fine abrasive particles of, for example, $CeO_2$ having a particle size of several $\mu$m or less and bonded together by a binder of synthetic resin.

The top ring 3 is coupled to a motor (not shown) and connected to a lifting/lowering cylinder (not shown). Therefore, the top ring 3 is vertically movable and rotatable about its own axis, as indicated by the arrows, and can press the semiconductor wafer 2 against the polishing cloth 4 under a desired pressure. The top ring 3 is connected to the lower end of a vertical top ring shaft 8, and supports on its lower surface an elastic pad 9 of polyurethane or the like. A cylindrical retainer ring 6 is provided around an outer circumferential edge of the top ring 3 for preventing the semiconductor wafer 2 from being dislodged from the top ring 3, while the semiconductor wafer 2 is being polished.

The top ring shaft 8 is supported by a top ring head 15 which is supported on a support shaft 16. When the support shaft 16 is rotated, the top ring head 15 is swung about the support shaft 16, and the top ring 3 is swung on the turntable 1 between the radially outer area and the radially inner area of the turntable 1.

A polishing liquid supply nozzle 5 is provided above the turntable 1 for supplying a polishing liquid Q onto the polishing cloth 4 on the turntable 1.

As shown in FIG. 1, a layer thickness measuring device 10 for measuring the thickness of an insulating layer or a metallic layer formed on the semiconductor wafer 2 is provided in the vicinity of the outer periphery of the turntable 1 and below the polishing surface of the turntable 1. The thickness measuring device is disposed under a locus in which the top ring 3 is swung around its support shaft. The layer thickness measuring device 10 is supported on a stationary section 11 such as a frame. The layer thickness measuring device 10 is electrically connected to a controller 13 by a wire 12. The layer thickness measuring device 10 comprises a light-emitting element and a light-detecting element. The light-emitting element applies light to the surface, being polished, of the semiconductor substrate, and the light-detecting element detects reflected light from the surface of the semiconductor substrate. The light-emitting element comprises a laser beam source or an LED.

Figure 2:
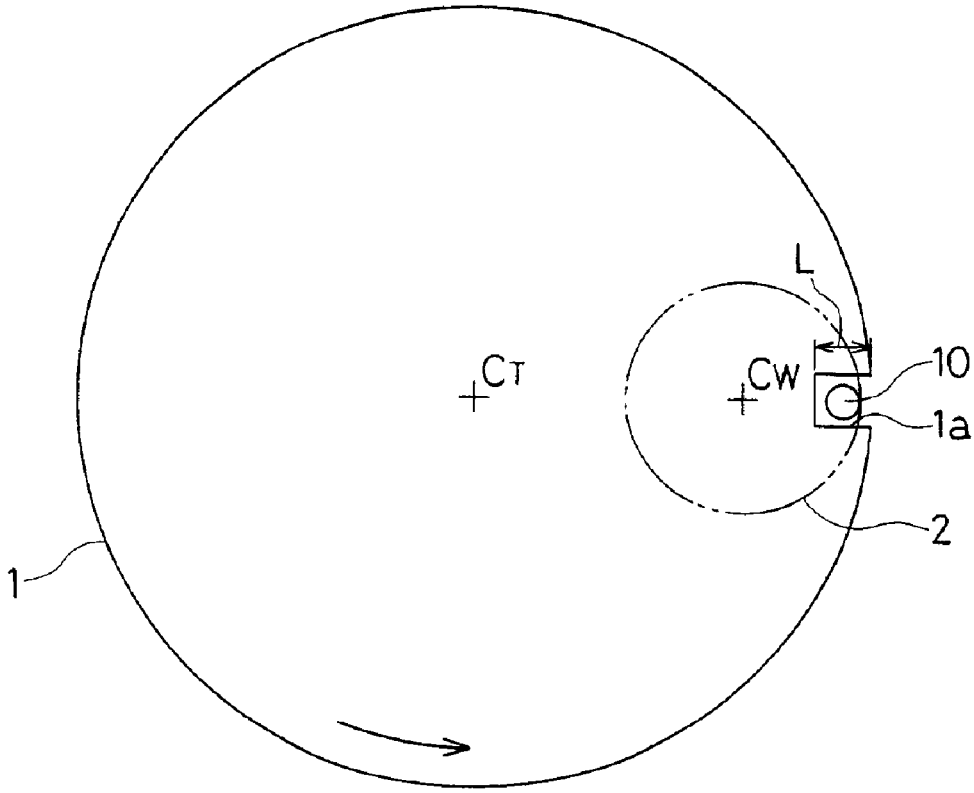
FIG. 2 is a plan view of a turntable in a polishing apparatus according to the present invention.

FIG. 2 is a plan view of the turntable in the polishing apparatus shown in FIG. 1. As shown in FIG. 2, a notch or recess 1*a* is formed in the turntable 1 at its position corresponding to the layer thickness measuring device 10. This notch 1*a* extends radially inwardly to the position corresponding to a slightly inward position from the outer circumferential edge of the semiconductor wafer 2 which is being polished. The layer thickness measuring device 10 is located in the vicinity of the radially inner end of the notch 1*a*. In FIG. 2, the symbol $C_T$ represents the center of rotation of the turntable 1, and the symbol $C_W$ represents the center of the semiconductor wafer 2. Therefore, every time when the turntable 1 makes one revolution, light emitted from the light-emitting element in the layer thickness measuring device 10 passes through the notch 1*a* and is incident on the surface, being polished, of the semiconductor wafer 2, and light reflected from the surface of the semiconductor wafer 2 is incident on the light-detecting element in the layer thickness measuring device 10. The light received by the light-detecting element is processed by the controller 13 to measure the thickness of the top layer on the semiconductor wafer 2. In this case, the position on the surface, being polished, of the semiconductor wafer 2 measured by the layer thickness measuring device 10 is located slightly inward from the outer circumferential edge of the semiconductor wafer 2.

Next, the principles of detecting the thickness of an insulating layer of $SiO_2$ or the like, or a metallic layer of copper or aluminum by the layer thickness measuring device will be briefly described.

The principles of detecting the thickness of the layer by the layer thickness measuring device utilizes the interference of light caused by the top layer and a medium adjacent to the top layer. When light is applied to a thin layer on a substrate, a part of the light is reflected from the surface of the thin layer while the remaining part of the light is transmitted through the thin layer. A part of the transmitted light is then reflected from the surface of the underlayer or the substrate, while the remaining part of the transmitted light is transmitted through the underlayer or the substrate. In this case, when the underlayer is made of a metal, the light is absorbed in the underlayer. The phase difference between the light reflected from the surface of the thin layer and the light reflected from the surface of the underlayer or the substrate creates the interference. When the phases of the two lights are identical to each other, the light intensity is increased, while when the phases of the two lights are opposite to each other, the light intensity is decreased. That is, the reflection intensity varies with the wavelength of the incident light, the layer thickness, and the refractive index of the layer. The light reflected from the substrate is separated by a diffraction grating or the like, and a profile depicted by plotting the intensity of reflected light for each wavelength is analyzed to measure the thickness of the layer on the substrate.

Next, a method for monitoring the thickness of a layer on a semiconductor wafer which is being polished will be described with reference to FIGS. 3A through 3C.

A semiconductor wafer 2 is held on the lower surface of the top ring 3, and pressed by the lifting/lowering cylinder against the polishing cloth 4 on the turntable 1 which is rotating. The polishing liquid supply nozzle 5 supplies the polishing liquid Q to the polishing cloth 4 on the turntable 1, and the supplied polishing liquid Q is retained on the polishing cloth 4. The semiconductor wafer 2 is polished in the presence of the polishing liquid Q between the lower surface of the semiconductor wafer 2 and the polishing cloth 4. While the semiconductor wafer 2 is being thus polished, as shown in FIG. 3A, the notch 1*a* of the turntable 1 passes directly above the layer thickness measuring device 10 every time when the turntable 1 makes one revolution. Therefore, light emitted from the light-emitting element in the layer thickness measuring device 10 passes through the notch 1*a* and reaches the surface, being polished, of the semiconductor wafer 2, and light reflected from the surface of the semiconductor wafer 2 is received by the light-detecting element to measure the thickness of the layer on the semiconductor wafer 2. During the polishing operation, every time when the turntable 1 makes one revolution, the measurement of the thickness of the layer on the semiconductor wafer 2 is repeated in the manner as described above. In this case, as described above, the position on the surface, being polished, of the semiconductor wafer 2 measured by the layer thickness measuring device 10 is located slightly inward from the outer circumferential edge of the semiconductor wafer 2.

Figure 3A:
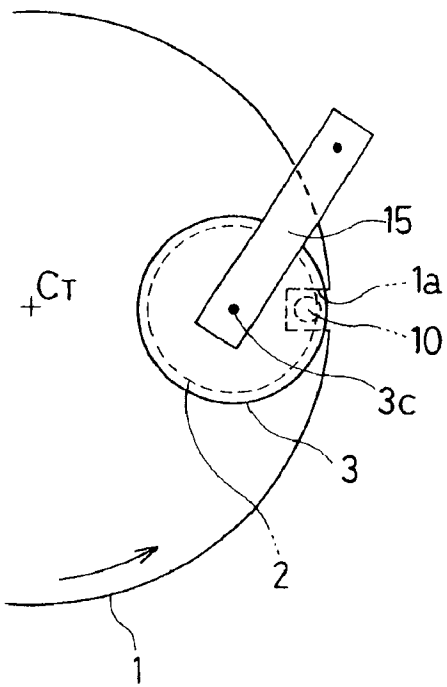
FIGS. 3A through 3C are schematic views showing a method for monitoring the thickness of a layer on a semiconductor wafer which is being polished.
Figure 3B:
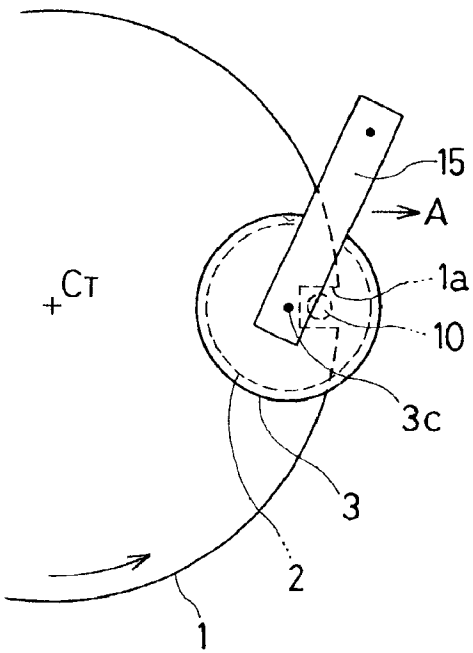

Next, by rotating the support shaft 16, as shown in FIG. 3B, the top ring head 15 is swung in a direction indicated by an arrow A, and hence the top ring 3 is moved radially outwardly on the turntable 1. Thus, the radially inner area of the surface, being polished, of the semiconductor wafer 2 can be measured by the layer thickness measuring device 10.

Figure 3C:
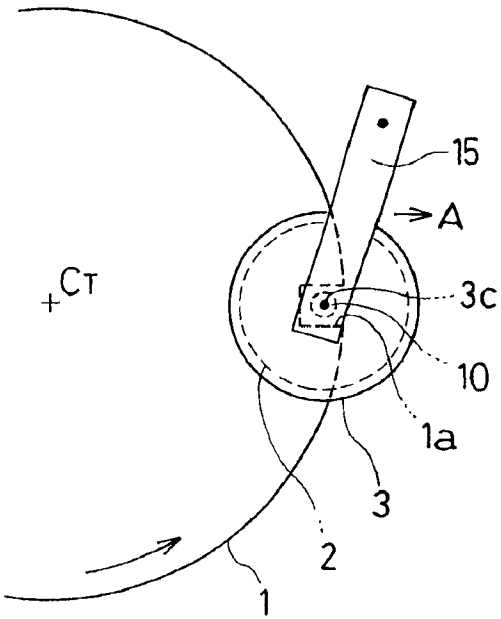

When the support shaft 16 is further rotated, as shown in FIG. 3C, the top ring head 15 is further swung in a direction indicated by the arrow A, and hence the top ring 3 is further moved radially outwardly on the turntable 1. Thus, the position near or around the center $C_W$ of the surface, being polished, of the semiconductor wafer 2 can be measured by the layer thickness measuring device 10. At this time, the measurement can be made without the need to excessively protrude the surface of the semiconductor wafer 2 from the turntable 1. Specifically, the center $C_W$ of the semiconductor wafer 2, i.e., the center 3*c* of the top ring 3 is located on the turntable 1, and the top ring 3 having a gimbal mechanism is prevented from being inclined, even if the top ring 3 projects from the turntable 1.

As shown in FIGS. 3A through 3C, when the top ring 3 is swung at the position of the notch 1*a* between the radially inner area and the radially outer area of the turntable 1, the thickness of the insulating layer or the metallic layer formed on the semiconductor wafer 2 can be detected, as continuous measurements on a real-time basis, along a predetermined path extending from the outer circumferential edge to the center of the semiconductor wafer by the layer thickness device 10. Thus, the thickness of the insulating layer or the metallic layer on the semiconductor wafer can be monitored at all times, and the end point of the CMP process can be accurately detected by detecting the following: The layer on the semiconductor wafer has been polished to a desired thickness, or the layer such as a copper layer on the surface areas of the semiconductor wafer other than the interconnection grooves has been removed until the layer thickness has become zero.

In the embodiment shown in FIGS. 1 through 3C, the length L (see FIG. 2) of the notch or recess 1*a*, provided in the turntable 1, in the radial direction of the turntable 1 is set so as to satisfy the following requirements.

1) In such a state that the top ring is not swung, the layer thickness device 10 disposed within the notch 1*a* can measure the thickness of the layer in a predetermined position located between the center and the outer circumferential edge of the surface, being polished, of the semiconductor wafer.

2) In such a state that the top ring is swung radially outwardly of the turntable, the layer thickness device 10 disposed within the notch 1*a* can measure the thickness of the layer in the central area of the surface, being polished, of the semiconductor wafer. In this case, even when the top ring is swung to a maximum, the area of the semiconductor wafer which projects outwards beyond the outer circumferential edge of the turntable and is exposed to the outside is preferably not more than 40% of the entire area of the surface, being polished, of the semiconductor wafer.

Figure 4:
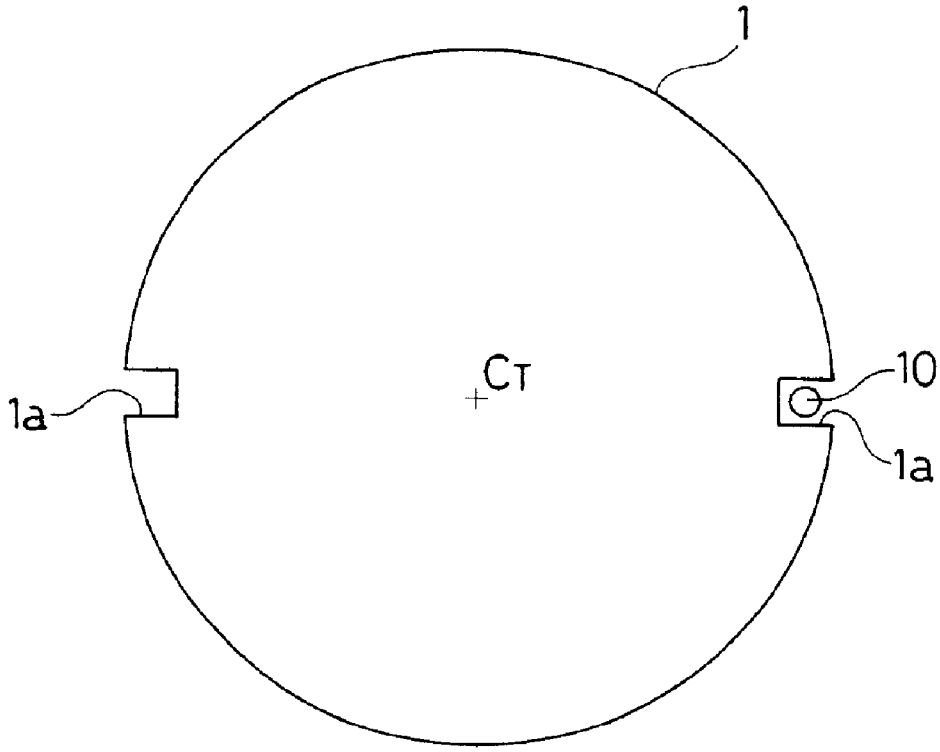
FIG. 4 is a plan view showing a polishing apparatus according to another embodiment of the present invention.

FIG. 4 is a plan view showing a polishing apparatus according to another embodiment of the present invention. According to this embodiment, two notches 1*a* are formed in the turntable 1 and located in diametrally opposite directions. This structure shown in FIG. 4 allows the detection time interval to be shortened to one-half the detection time interval in the embodiment shown in FIG. 2. The number of notches 1*a* may be not less than 3.

In the embodiments shown in FIGS. 1 through 4, a nozzle for supplying a cleaning liquid is provided adjacent to the layer thickness device 10 so that the layer thickness device 10, when soiled with the polishing liquid, can be cleaned. The cleaning liquid can be supplied through the nozzle to the layer thickness device 10 continuously or intermittently during polishing. According to the embodiments shown in FIGS. 1 through 4, it is only necessary to provide a relatively small notch or notches in the outer periphery of the turntable, and hence there is no need to take any special measure for preventing the polishing liquid from leaking from the turntable, and the polishing liquid which has dropped through the notch 1*a* can be received by a conventional trough (not shown) provided around the turntable.

As described above, according to the present invention, the thickness of an insulating layer or a metallic layer formed on a semiconductor substrate can be detected as continuous measurements on a real-time basis during polishing, and there is no need to cause the surface of the semiconductor substrate to excessively project from a turntable.

Further, it is only necessary to provide a notch or notches (recess or recesses) on the periphery of the turntable, and there is no need to provide a through-hole for allowing light emitted from an optical measuring device to pass therethrough in a main part of the polishing surface, e.g. an intermediate portion between the center and the periphery of the turntable. Therefore, a lowering in polishing performance involved in the provision of an optical measuring device can be minimized, and it is not necessary to provide a covering member such as a glass window for covering the through-hole formed in the turntable.

Figure 5:
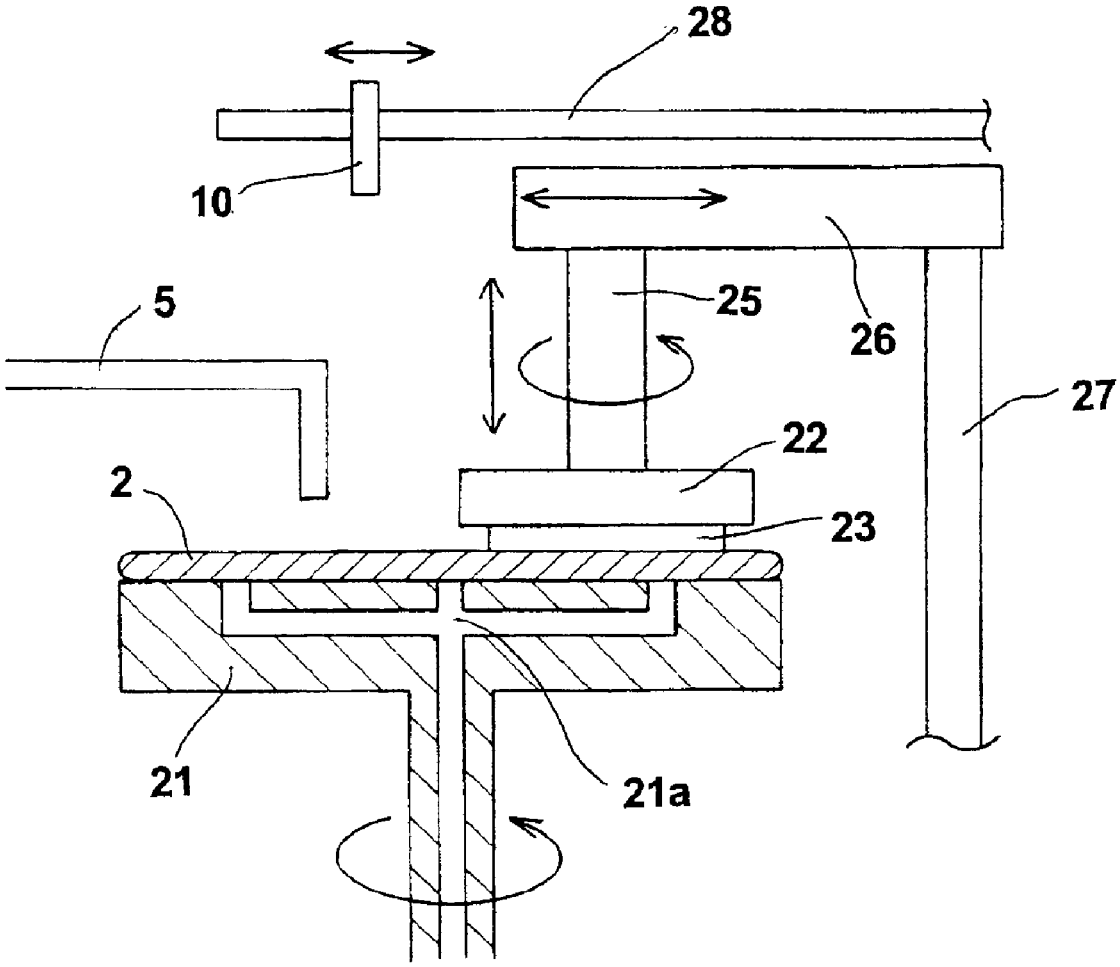
FIG. 5 is a vertical cross-sectional view of the whole structure of a polishing apparatus according to a second embodiment of the present invention.

FIG. 5 is a vertical cross-sectional view of the whole structure of a polishing apparatus according to a second embodiment of the present invention. As shown in FIG. 5, a polishing apparatus has a wafer holder 21 constituting a top ring for holding a semiconductor wafer 2 under vacuum developed in a fluid passage 21*a*, and a polishing tool holder 22 constituting a polishing table for holding a polishing tool 23 and pressing the polishing tool 23 against the semiconductor wafer 2 held by the wafer holder 21. The wafer holder 21 is coupled to a motor (not shown), and is rotatable about its own axis, as indicated by the arrow. The fluid passage 21*a* communicates with a vacuum pump.

The polishing tool holder 22 is coupled to a motor (not shown) and connected to a lifting/lowering cylinder (not shown). Therefore, the polishing tool holder 22 is vertically movable and rotatable about its own axis, as indicated by the arrows, and can press the polishing tool 23 against the semiconductor wafer 2 under a desired pressure. The polishing tool 23 comprises a fixed abrasive plate comprising a disk of fine abrasive particles of, for example, $CeO_2$ having a particle size of several $\mu$m or less and bonded together by a binder of synthetic resin, and constitutes a polishing surface. The polishing tool holder 22 is connected to the lower end of a vertical shaft 25, and the vertical shaft 25 is supported by a polishing tool head 26 which is supported on a support shaft 27. The polishing tool holder 22 is movable radially of the wafer holder 21 between the radially outer area and the radially inner area of the wafer holder 21 by the polishing holder head 26 which is swung by the rotation of the support shaft 27.

A polishing liquid supply nozzle 5 is provided above the wafer holder 21 for supplying a polishing liquid such as pure water onto the semiconductor wafer 2. A layer thickness measuring device 10 for measuring the thickness of an insulating layer or a metallic layer formed on the semiconductor wafer 2 is provided above the wafer holder 21. The layer thickness measuring device 10 has the same structure as that in FIG. 1, and is movable radially of the wafer holder 21 along a guide rail 28.

With the above structure, the semiconductor wafer 2 is held by the wafer holder 21 under vacuum, and the polishing tool 23 is pressed against the semiconductor wafer 2 by the polishing tool holder 22. The polishing liquid supply nozzle 5 supplies the polishing liquid to the semiconductor wafer 2, and the supplied polishing liquid is retained on the semiconductor wafer 2. The semiconductor wafer 2 is polished in the presence of the polishing liquid between the upper surface of the semiconductor wafer 2 and the polishing tool 23. While the semiconductor wafer 2 is being thus polished, the layer thickness measuring device 10 measures the thickness of the insulating layer or the metallic layer formed on the semiconductor wafer 2. During polishing, the polishing tool holder 22 is movable between the radially outer area and the radially inner area of the semiconductor wafer 2 to polish the whole surface of the semiconductor wafer 2. As the polishing tool 23 is moved radially of the semiconductor wafer 2, the layer thickness measuring device 10 is moved radially of the semiconductor wafer 2 in synchronism with the polishing tool 23, and therefore the layer thickness measuring device 10 can measure the thickness of the top layer such as the insulating layer or the metallic layer from the center to the outer circumferencial edge of the semiconductor wafer 2 on a real-time basis during polishing.

Although certain preferred embodiments of the present invention have been shown and described in detail, it should be understood that various changes and modifications may be made therein without departing from the scope of the appended claims.

What is claimed is:

1. A polishing apparatus comprising:

a polishing table having a polishing surface including an outer peripheral portion and a main part;

a top ring adapted to hold a substrate and press a surface of the substrate against said main part of said polishing surface to polish a layer formed on the surface of the substrate, said top ring being swingable on said polishing surface between said main part and said outer peripheral portion of said polishing surface;

at least one notch formed in said outer peripheral portion of said polishing surface; and at least one optical measuring device disposed adjacent to said at least one notch for measuring a thickness of a layer formed on the surface of the substrate, said at least one notch allowing light emitted from said at least one optical measuring device to pass therethrough, wherein said top ring is swung radially outwardly to said outer peripheral portion of said polishing surface such that said at least one optical measuring device is able to measure the thickness of the layer formed on the surface of the substrate from an outer circumferential edge of the substrate to a center of the substrate in a continuous manner when the thickness of the layer formed on the surface of the substrate is measured by said at least one optical measuring device.

2. A polishing apparatus according to claim 1, wherein said top ring is swingable so that the light emitted from said at least one optical measuring device is incident on at least a central portion of the substrate.

3. A polishing apparatus according to claim 2, wherein when said top ring is swung to a maximum, an area of the substrate which projects outward beyond an outer circumferential edge of said polishing surface is not more than 40% of an entire area of the surface of the substrate being polished.

4. A polishing apparatus according to claim 1, further comprising a nozzle operable to supply a cleaning liquid to said at least one optical measuring device.

5. A polishing apparatus according to claim 1, wherein said polishing surface has at least one additional notch formed in said outer peripheral portion of said polishing surface.

6. A polishing apparatus comprising:

a rotatable polishing table having a polishing surface including a center portion, an outer peripheral portion, and an intermediate portion between said center portion and said outer peripheral portion;

a top ring adapted to hold a substrate and press a surface of the substrate against said intermediate portion of said polishing surface to polish a layer formed on the surface of the substrate, said top ring being swingable on said polishing surface between said intermediate portion and said outer peripheral portion of said polishing surface;

at least one notch formed in said outer peripheral portion of said polishing surface; and at least one optical measuring device disposed adjacent to said at least one notch for measuring a thickness of the layer formed on the surface of the substrate, said at least one notch allowing light emitted from said at least one optical measuring device to pass therethrough, wherein said top ring is swung radially outwardly to said outer peripheral portion of said polishing surface such that said at least one optical measuring device is able to measure the thickness of the layer formed on the surface of the substrate from an outer circumferential edge of the substrate to a center of the substrate in a continuous manner when the thickness of the layer formed on the surface of the substrate is measured by said at least one optical measuring device so that the light emitted from said at least one optical measuring device is incident on at least a central portion of the substrate.

7. A polishing apparatus according to claim 6, wherein when said top ring is swung to a maximum, an area of the substrate which projects outward beyond an outer circumferential edge of said polishing surface is not more than 40% of an entire area of the surface of the substrate being polished.

8. A polishing apparatus according to claim 6, further comprising a nozzle operable to supply a cleaning liquid to said at least one optical measuring device.

9. A polishing apparatus according to claim 6, wherein said polishing surface has at least one additional notch formed in said outer peripheral portion of said polishing surface.

10. A polishing apparatus comprising:

a rotatable polishing table having a polishing surface including a center portion, an outer peripheral portion, and an intermediate portion between said center portion and said outer peripheral portion;

a top ring adapted to hold a substrate and press a surface of the substrate against said intermediate portion of said polishing surface to polish a layer formed on the surface of the substrate, said top ring being swingable on said polishing surface between said intermediate portion and said outer peripheral portion of said polishing surface, at least one notch formed in said outer peripheral portion of said polishing surface; and at least one optical measuring device disposed adjacent to said at least one notch for measuring a thickness of the layer formed on the surface of the substrate, said at least one notch allowing light emitted from said at least one optical measuring device to pass therethrough, wherein said top ring is swung radially outwardly to said outer peripheral portion of said polishing surface such that said at least one optical measuring device is able to measure the thickness of the layer formed on the surface of the substrate from an outer circumferential edge of the substrate to a center of the substrate in a continuous manner when the thickness of the layer formed on the surface of the substrate is measured by said at least one optical measuring device so that the light emitted from said at least one optical measuring device is incident on at least a central portion of the substrate, and wherein said top ring has a mechanism so as to follow an inclination of said polishing surface.

11. A polishing apparatus according to claim 1, wherein said main part of said polishing surface has no through-holes.

12. A polishing apparatus according to claim 6, wherein said intermediate portion of said polishing surface has no through-holes.

13. A polishing apparatus according to claim 10, wherein said intermediate portion of said polishing surface has no through-holes.

* * * * *